United States Patent [19]

Takahashi et al.

[11] 4,224,108

[45] Sep. 23, 1980

[54] DECOKING APPARATUS

[75] Inventors: Hisao Takahashi, Yokohama; Takeshi Nomura, Tokyo; Kiyoji Ozaki; Haruo Izumida, both of Yokohama; Naotaka Miwa, Ichihara; Naoshi Kawabe, Ichihara; Masatomo Shigeta, Ichihara; Hiroshi Hozuma, Ichihara; Seiichi Suzuki, Iwaki, all of Japan

[73] Assignee: Kureha Kagaku Kogyo Kabushiki Kaisha, Nihonbashi, Japan

[21] Appl. No.: 874,946

[22] Filed: Feb. 3, 1978

[30] Foreign Application Priority Data

Feb. 4, 1977 [JP] Japan ..... 52-11555[U]

[51] Int. Cl.[2] ..... C10G 9/12

[52] U.S. Cl. ..... 196/122; 134/167 R; 134/168 R; 196/126; 196/127; 202/241; 208/48 Q; 239/226; 239/227; 261/88; 422/129; 422/225

[58] Field of Search ..... 196/122, 126–128; 201/2; 202/241; 134/22, 24, 39, 167, 168; 208/48 R, 48 Q; 422/129, 225, 226; 239/226, 227; 261/88

[56] References Cited

U.S. PATENT DOCUMENTS

| | | | |
|---|---|---|---|
| 1,783,257 | 12/1930 | Morrell | 196/107 X |
| 1,912,629 | 6/1933 | Fisher | 208/48 R X |
| 2,326,525 | 8/1943 | Diwoky | 196/122 X |
| 3,522,016 | 7/1970 | Groves et al. | 134/39 X |
| 3,836,434 | 9/1974 | Novy | 134/39 X |
| 3,953,226 | 4/1976 | Emond | 134/168 R |
| 3,985,572 | 10/1976 | Petermann et al. | 134/22 R X |
| 4,127,473 | 11/1978 | Hozuma et al. | 208/48 R |

FOREIGN PATENT DOCUMENTS

| | | |
|---|---|---|
| 2647526 | 4/1977 | Fed. Rep. of Germany . |
| 2328759 | 5/1977 | France . |

*Primary Examiner*—Michael S. Marcus

*Attorney, Agent, or Firm*—Stevens, Davis, Miller & Mosher

[57] ABSTRACT

A decoking apparatus suitable for use on a reaction vessel for the thermal cracking of heavy petroleum oils the apparatus essentially including a rotatable main injection pipe to be disposed in the reaction vessel and having a multitude of jet nozzles along its length, and a second or auxiliary injection pipe positioned in the proximity of the main injection pipe to inject a scrubbing liquid over the outer peripheral walls of the main injection pipe to prevent deposition of coke. The main and auxiliary injection pipes are both supplied with heavy petroleum oil to remove the coke deposition from the reactor wall by the heavy petroleum oil jets from the main injection pipe while wetting the exterior of the main pipe with the heavy petroleum oil injected by the auxiliary injection pipe.

5 Claims, 3 Drawing Figures

DECOKING APPARATUS

BACKGROUND OF THE INVENTION

1. Field of the Invention

The invention relates to a decoking apparatus, and more particularly to a decoking apparatus useful for removing coke deposited on the inner wall surfaces of a reaction vessel for the thermal cracking of heavy petroleum oils.

In the production of pitches, heavy petroleum oils (hereinafter referred to as heavy oils) such as asphalt and coal-tar are usually thermally cracked in a reaction vessel. In this connection, it is the general practice to admit a hot gas, which does not react with the heavy oils, in the temperature range of 400 to 2000° C. into the reaction vessel through its bottom to induce thermal cracking of the charged material. During the cracking operation, the charged material undergoes intense bubbling and spatters around onto the inner wall surfaces of the reaction vessel, forming deposits of coke thereon. The coke deposit grows to a substantial thickness while the reaction vessel is used for several batches and partially comes off the reactor wall, causing various problems in the subsequent operations, for example, clogging of the nozzle through which the reacted product is drawn out.

2. Description of Prior Art

The countermeasure which has been conventionally adapted is removal of the deposited coke by high-pressure water jets or by mechanical scraping after the reaction vessel has been used for several batches or when the coke deposit has growth to certain extent. However, these conventional methods invariably necessitate cooling to room temperature the reaction vessel which has been maintained at about 400° C., requiring suspension of the cracking operation for a long period of time and compelling the operator to do the coke removal in an undesirable environment.

In view of the difficulties encoutered in the coke removing operation, we have already developed a new concept of injecting part of charging material through a rotary nozzle toward the inner wall surfaces of the reactor to remove the deposited coke therefrom. This prior invention succeeded in eliminating the above-mentioned difficulties of the conventional methods but turned out to have a problem in that coke deposits on the rotary nozzle itself to impair its function or to increase its weight unduely.

SUMMARY OF THE INVENTION

The present invention has as its object the elimination of the above-mentioned difficulties inherent to the conventional methods and the problems of our prior invention. This object is achieved in a most suitable manner by the present invention, which along with other objects, advantages and features of the invention will become apparent from the following description.

According to the present invention, there is provided a decoking apparatus for a reaction vessel for the thermal cracking of heavy oils, comprising a drive mechanism provided above the reaction vessel, an injection pipe assembly disposed in the reaction vessel and driven by the drive mechanism, the injection pipe assembly including a main injection pipe rotatable about the vertical axis of the reactor and having a number of jets nozzles for spouting jets of scrubbing liquid against the inner wall surfaces of the reactor, and an auxiliary injection pipe positioned to spout a scrubbing liquid around the outer circumference of the main injection pipe.

The above-mentioned main and auxiliary injection pipes are supplied with the raw liquid material or heavy oils to be charged into the reactor. The main injection pipe is calibrated to inject jets of raw material against the inner wall surfaces of the reactor at a pressure of at most 20 kg/cm$^2$ thereby to remove the coke deposits from the wall surfaces, while the auxiliary injection pipe is adapted to spout pressurized or nonpressurized raw material on the main injection pipe to keep its outer surface in a wet state for the prevention of coke deposition. In some cases, the auxiliary injection pipe may be adapted to inject the raw material at a pressure of several kg/cm$^2$.

In one preferred form of the invention, the main injection pipe is rotatable about the vertical axis of the reactor and at the same time movable up and down along the vertical axis of the reactor. The vertical movements of the main injection pipe ensure that the decoking jets will sweep the entire interior of the reactor even when the main injection pipe is provided with the jet nozzles at intervals along its length. For the compactness of the apparatus as a whole, the auxiliary injection pipe is preferred to have its upper section mounted within the main injection pipe, extending along the longitudinal axis of the latter. In this instance, the lower end portion of the auxiliary injection pipe is brought out through the wall of the main injection pipe, suitably at a position where the main pipe is bent toward the side wall of the reaction vessel as will be described hereinlater.

The main injection pipe which directs high-pressure jets against the interior surface of the reactor is susceptible to shuddering vibrations under the influence of the reactions of the jet pressure and the vigorous bubbling action of the high pressure vapors which form during the cracking operation. Therefore, it is preferred to provide an anti-vibratory means for the main injection pipe.

DETAILED DESCRIPTION OF THE INVENTION

Figure 1:
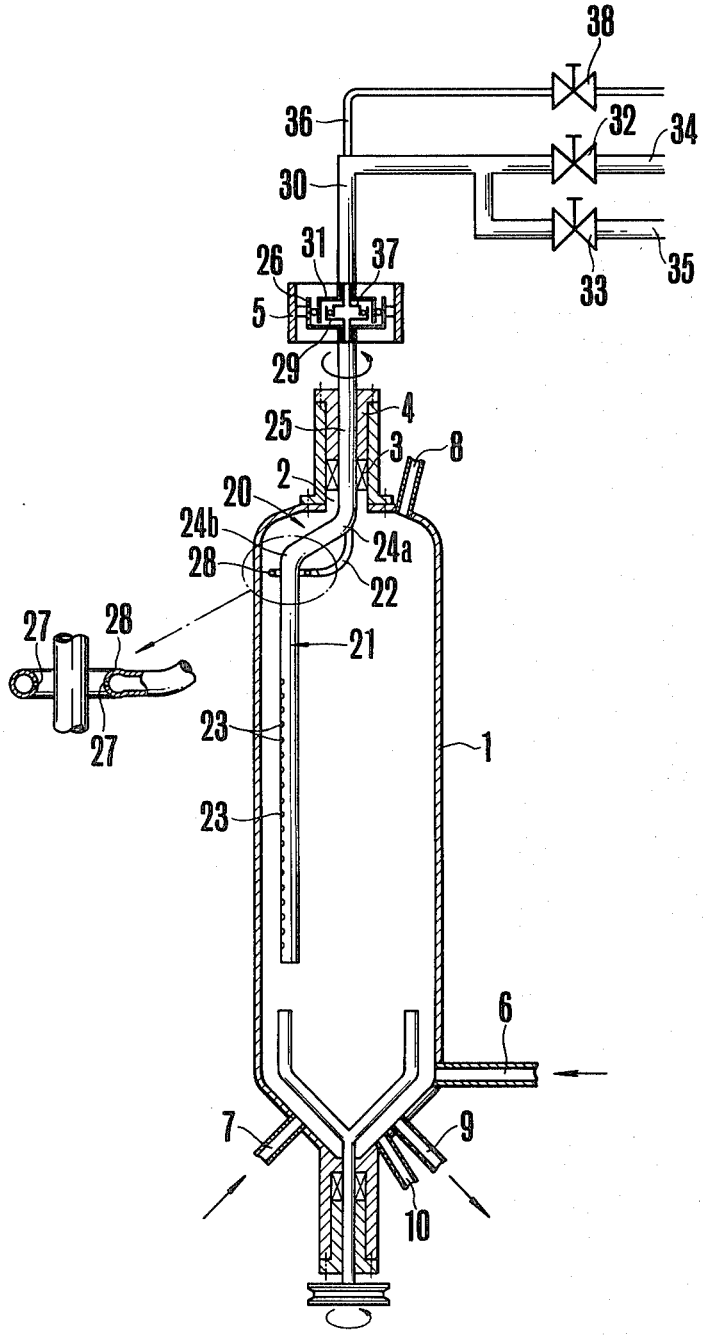
FIG. 1 is a partially sectioned, schematic view showing the decoking apparatus of the invention as mounted on a heavy oil cracking reactor.

Referring to FIG. 1, the decoking apparatus according to the present invention is mounted on a reaction vessel 1 which is used for the thermal cracking of heavy oil. The construction of the reactor 1 itself is conventional and thus its explanation is omitted. The decoking apparatus generally indicated at 20 includes a main injection pipe 21 and an auxiliary injection pipe 22 which are disposed within the reactor 1 and are rotatable about the vertical axis thereof.

The main injection pipe 21 is provided with a series of vertically aligned jet nozzles 23 which are formed through its wall, at least on the side closely facing the reactor wall, to inject under high pressure jets of heavy oil against the inner wall of the reactor 1. The jet nozzles 23 are provided at an angle of 45° downwardly with respect to the longitudinal axis of the main injection pipe 21. The number and the arrangement of the jet nozzles can be determined arbitrarily in relation to the amount and the pressure of the heavy oil to be injected therethrough. The main injection pipe 21 is closed at its lower end and has two bent portions 24*a* and 24*b* so that its lower end extends along the interior vertical wall of the reactor in a closely opposing relationship. As a result, the jet nozzles 23 of the main injection pipe 21 are maintained at a close distance from the inner wall surface of the reactor 1. The upper straight portion of the main injection pipe 21 extends upwardly through an opening in the top of the reactor 1, more specifically, through a bearing 3 which rotatably supports the pipe 21 and through packing and packing gland 4 which hermetically seal the upper opening 2 of the reactor to prevent leakage of gases from the reactor 1. The distal end of the upper straight portion 25 of the main injection pipe 21 is connected to a coupling cup 26 which is secured to a gear 5 which in turn is driven from an electric motor (not shown).

The auxiliary injection pipe 22 which extends through the center of the upper straight portion 25 of the main injection pipe 21 pierces the bend at the lower end of the upper straight portion 25 and carries at its lower end, an annular nozzle pipe 28 which is provided with a number of jet nozzles 27 in its wall facing the main injection pipe 21. At the bent portion where the auxiliary injection pipe 22 pierces pipe 21, its circumferential wall is hermetically welded to the main injection pipe 21, to prevent leakage of the scrubbing liquid which is fed to the main injection pipe 21. The upper end of the auxiliary injection pipe 22 is connected to a coupling cup 29 which is rotatable with the afore-mentioned coupling cup 26.

The injecting heavy oil is fed to the main pipe 21 through a fixed feed pipe 30 which has at its lower end a coupling cup 31 rotatably mounted within coupling cup 26 and has its upper end connected to bifurcated pipes 34 and 35 through valves 32 and 33, respectively. Extending through the vertical riser portion of the fixed pipe 30 is a second fixed pipe 36 fixed at its lower end to a coupling cup 37 rotatably mounted within the aforementioned coupling cup 29. The second fixed pipe 36 is provided with a pressure-reducing valve 38 for the adjustment of the injection pressure. Either one of the coupling cups 26 and 31 may be formed of the smaller diameter and fitted within the other through an O-ring in such a manner as to allow relative rotary movement between the two cups. The same applies to the other pair of coupling cups 29 and 37.

The heavy oil to be subjected to the thermal cracking is charged into the reaction vessel 1 through an inlet pipe 6, while superheated steam at 400° C. to 2000° C. is introduced into the vessel through another inlet pipe 7. During the cracking operation, a fluid such as nitrogen gas or steam which is inert to the thermal decomposition reactions of the heavy oil is fed to the main injection pipe 21 through the pipe 34 and injected through the jet nozzles 23 to prevent the nozzles 23 from being clogged with the reaction material charged in the reactor 1. At this time, it is not necessary to rotate the main injection pipe 21.

Part of heavy oil charged is fed through the second fixed pipe 36 to the auxiliary injection pipe 22 after pressure adjustment at the pressure-reducing valve 38, for example, to a lower level of 1 kg/cm$^2$, and injected from the annular nozzle 28 over the exterior of the main injection pipe 21 to keep its exterior in a wet state. Therefore, the splashes of the bubbling heavy oil are prevented from depositing and hardening on the exterior of the main injection pipe 21. Designated at 8 in FIG. 1 is an exhaust port for the inert gas and the gases which form during the cracking operation, and at 9 is an outlet for the reaction product.

Upon completion of cracking of the charged heavy oil, the decomposition product is discharged through the outlet 9, and the valve 32 is closed to stop the injection of inert gas through the jet nozzles 23. Thereafter, the valve 33 is opened to feed part of the heavy oil for the next batch from the pipe 35 to the second fixed pipe 30 under a high pressure, for example, at 20 kg/cm$^2$, injecting through jet nozzles 23 high-pressure jets of heavy oil against the interior of the reaction vessel 1. During the injection of heavy oil, the main nozzle pipe is rotated by the drive mechanism through the gear 5. In this manner, the coke which has deposited on the interior of the reaction vessel 1 during the preceding cracking operation is removed and discharged through the outlet pipe 10. Since the deposited coke is removed after every batch cracking operation, it is small in amount and can be easily discharged without clogging the outlet pipe 10. As soon as the decoking of the reactor walls is finished, the rotation of the main injection pipe 21 is stopped and the valve 33 is closed to cease the injection of heavy oil through the jet nozzles 23. Thereafter, the valve 32 is opened again to feed the inert fluid to the main injection pipe 21 until the end of the next cracking operation.

Figure 2:
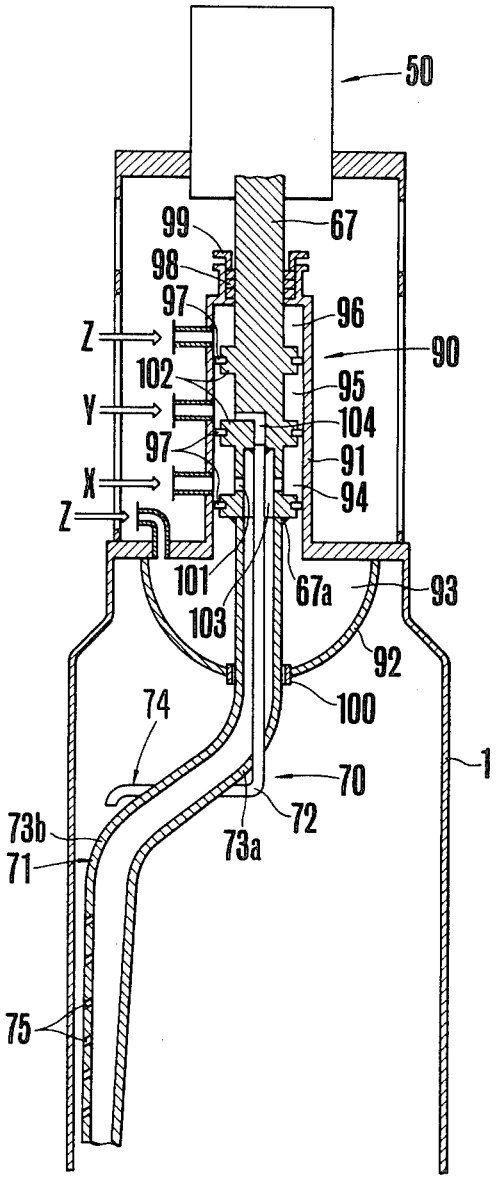
FIG. 2 is a schematic sectional view of another embodiment of the invention.
Figure 3:
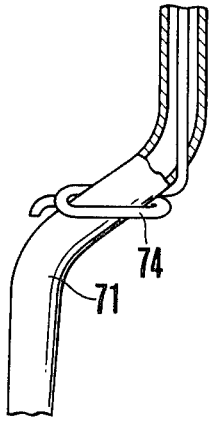
FIG. 3 is a schematic view showing a different arrangement of the auxiliary injection pipe on the main injection pipe.

Referring to FIGS. 2 and 3, there is shown another embodiment of the present invention, wherein the decoking apparatus also has a drive assembly 50 mounted over a reaction vessel for the pipe rotating and reciprocating movements. The drive shaft (not shown) of the drive assembly is connected through a piston rod 67 to an upper end of an injection pipe assembly 70 which is disposed within the reaction vessel 1, and a cylinder assembly 90 is mounted on top of the reaction vessel 1 to feed decoking heavy oil to the injection pipe assembly while hermetically sealing the top end of the reaction vessel.

The drive assembly 50, a mechanism which is well-known per se, includes an electric motor and a reduction gear for rotating and reciprocating the injection pipe assembly 70 through the drive shaft. The drive assembly 50 is provided with a control circuit for sequentially controlling the rotational and reciprocating of the injection pipe assembly 70.

Furthermore, the drive assembly is so constructed that both radial and thrust loads imparted to it are born within itself to make it compact.

The injection pipe assembly 70 disposed in the reaction vessel 1 has the substantially same construction as the injection pipe in the first embodiment. However, in the second embodiment, the auxiliary injection pipe is arranged in a slightly different manner. More particularly, as in the first embodiment, the auxiliary injection pipe 72 extends through the center of the main injection pipe 71 as far as the bent portion 73*a* where the auxiliary pipe 72 passes through the wall of the main pipe 71. The lower end portion of the auxiliary injection pipe 72 which projects out of the main injection pipe 71 extends to and opens at a point over the bent portion 73*b*, where the main injection pipe 71 bends to extend closely along the inner wall surface of the reaction vessel 1. The open distal end of the auxiliary injection pipe 72 is located and disposed so that the heavy oil flows uniformly over the exterior of the main nozzle pipe 72. In this embodiment, the heavy oil to be poured on the outer surface of the main injection pipe 71 may be emitted by gravity or may be injected under pressure if desired. The free end 74 of the auxiliary injection pipe 72 may be helically wound around the circumference of the main injection pipe 71 as shown in FIG. 3. If arranged in this manner, the open end of the auxiliary injection pipe is maintained in a constant position relative to the main injection pipe 71, adapting itself to the contraction or elongation of the main injection pipe 72 due to thermal stress.

The main injection pipe 70 within the reaction vessel 1 has to be formed from a light material since it is exposed to high temperatures, shaken by the bubbling, stressed repeatedly by the reactions of the jets during the decoking operation, and influenced by the moments resulting from eccentric deviations of the main and auxiliary injection pipes 71 and 72. For example, the injection pipe portion 70 may be formed of a single carbon steel pipe which is inserted in the reaction vessel. It is conceivable to provide a main injection pipe which is bifurcated or trifurcated at the lower end of its upper straight portion but this is not desirable in view of the above-mentioned stress factors. The main injection pipe 71 is provided with jet nozzles 75 in the same manner as in the first embodiment.

The main and auxiliary injection pipes 71 and 72 and the piston rod 67 are assembled by the following procedure. The piston 67 is provided with an axial bore 103 in its lower end face. The bore 103 has the same diameter as the inside diameter of the main injection pipe 71 and communicates through a bottom passage 104 with a scrubbing liquid chamber 95 which will be described below. A straight pipe to be formed into the auxiliary injection pipe 72 is inserted into a through hole which is provided on the lower side of the bent portion of the main injection pipe 71, and the upper end of the auxiliary injection pipe 72 is then fitted into the bottom passage 104, welding the outer periphery of the auxiliary injection pipe 72 to the bottom of the bore 103. Thereafter, the upper end of the main injection pipe 71 is abutted against and welded to the lower end 67*a* of the piston 67. Finally, the auxiliary injection pipe 72 is welded to the main injection pipe 71, around its outer periphery where it projects out of the bent portion of the main pipe, and the projecting lower end of the auxiliary injection pipe is bent in the above-described manner.

The cylinder assembly 90 is mounted on top of the reaction vessel 1 to feed high pressure heavy oil and low pressure heavy oil to the main and auxiliary injection pipes 71 and 72, respectively, while sealing the upper end of the reaction vessel 1 to prevent leakage of inflammable gases and other material including heated asphalt. The cylinder assembly 90 has a cylinder 91 which is mounted on the upper end of the reaction vessel 1 and which has a bottom wall 92 extending from the underside of its base into the interior of the reaction vessel 1 to define a lower steam chamber 93 around the main injection pipe 72. The cylinder 91 further defines, in cooperation with the lands on the piston 67, a high-pressure heavy oil chamber 94, a low-pressure heavy oil chamber 95, and an upper steam chamber 96. These chambers are sealed by piston rings 97 on the respective lands. The upper steam chamber 96 is sealed from the atmosphere by packing 98 and packing gland 99. The bottom wall 92 of the lower steam chamber 93 is provided with a cylindrical anti-vibratory member 100 which prevents the vibration of the main injection pipe 71.

The high-pressure heavy oil chamber 94 of the cylinder 91 communicates with the main injection pipe 71 through an opening 101 and receives a supply of high-pressure heavy oil from the direction X for injection through the jet nozzles 75 of the main injection pipe 71 against the inner wall surfaces of the reaction vessel 1. The low-pressure heavy oil chamber 95 communicates with the auxiliary injection pipe 72 which receives a supply of low-pressure heavy oil from the direction Y to inject it from the lower end of the auxiliary injection pipe 72 onto the outer surface of the main injection pipe 71. The lower and upper steam chambers 93 and 96 respectively receive a supply of steam from the direction Z to ensure freedom of rotational and reciprocating movement of the injection pipe assembly 70 while completely sealing the gases and heavy oil within the reaction vessel 1 and the high-pressure and low-pressure heavy oil in the chambers 94 and 95 in cooperation with the piston 102, piston ring 97 and packing 98. The heavy oil can be charged while the injection pipe assembly is in the rotational or up-down shift operation.

In operation, the second embodiment of the above construction differs from the first embodiment in that steam is constantly fed to the respective steam chambers from the direction Z. During the batchwise cracking operation, low-pressure heavy oil is fed to the auxiliary injection pipe 72 to keep the exterior of the main injection pipe 71 in a wet state. Upon completion of one batch operation, high-pressure heavy oil is fed from the direction X into the main injection pipe 71 which is now put in rotation to inject the heavy oil against and around the interior of the reaction vessel 1. This embodiment also differs in that the main injection pipe is lifted as soon as it completes one round of decoking operation. The lifting of the main injection pipe 71 shifts the positions of the outwardly downwardly inclined jet nozzles 75 relative to the inner wall of the reaction vessel 1. In this connection, it is preferred to lift the main injection pipe 71 by a distance corresponding to the intervals between the individual jet nozzles 75 to ensure complete removal of the deposited coke. In this particular embodiment, the drive shaft has a full stroke length of 100 mm while the jet nozzles 75 are spaced from adjacent ones by a distance of about or shorter than 100 mm. This will be satisfactory for normal operations. The drive shaft is lifted each time by a distance corresponding to $\frac{1}{3}$ of its full stroke length, for instance, by controlling the rotation of the drive shaft with use of a tachometer. The rotation and up-down shifting of the main injection pipe 71 are effected separately in normal operations but both may be effected simultaneously.

Instead of shifting the injection pipe assembly by the drive assembly 50, it is possible to operate the piston cylinder by fluid pressure, for example, by moving the piston 67 up and down by controlling the pressures of steam to be admitted into the upper and lower steam chambers 96 and 93.

It will be appreciated from the foregoing description that, according to the present invention, the coke deposit on the reactor interior is removed by the high-pressure jets of hot heavy oil which is injected as a scrubbing liquid through the jet nozzles of the main injection pipe to allow continuously repeated cracking operation by the reactor, while injecting through the auxiliary injection pipe a similar raw material over the exterior of the main injection pipe to wet and to preclude coke deposition on the main injection pipe.

In addition, the rotation and up-down shifting of the main nozzle pipe within the reactor enlarges the area which is covered by the jets of scrubbing liquid and ensures more perfect removal of the deposited coke. During the rotation and up-down shifts of the injection pipe assembly, leakage of the gases and inflammable hot asphalt from within the reactor is completely prevented by the secure seals which are very simple in construction and which facilitate maintenance and inspection.

Moreover, in a case where the auxiliary injection pipe is helically wound around the main injection pipe, it can easily adapt itself to the thermal expansion of the main injection pipe exposed to high temperatures.

The provision of the anti-vibratory member on the main injection pipe precludes vibration of its nozzle portion and contributes to smoothen the rotation and up-down shift operations of the main injection pipe and ensure accurate coke removing and scrubbing operations.

What is claimed is:

1. A decoking apparatus for use on a reaction vessel for the thermal cracking of heavy petroleum oils, including (A) an injection pipe assembly comprising:

(1) a rotatable main injection pipe inserted into the reaction vessel and having a vertical straight leg portion extending along the inner wall of the reaction vessel in close proximity thereto, said straight leg portion being provided along the length thereof with a plurality of jets for spraying heavy petroleum oil against the inner wall; and (2) an auxiliary injection pipe rotatable with said main injection pipe extending into the reaction vessel and terminating at a position maintained over said vertical straight leg portion of said main injection pipe for injecting a scrubbing liquid over said main injection pipe to wet the outer surface of said vertical straight leg portion; and (B) means for rotating said injection pipe assembly.

2. The apparatus of claim 1 wherein the upper end of said auxiliary injection pipe is mounted within said main injection pipe.

3. The decoking apparatus as defined in claim 1, wherein said rotatable main injection pipe is movable up and down along the vertical axis of said reaction vessel.

4. The decoking apparatus as defined in claims 1 or 3, wherein said auxiliary injection pipe has its lower end helically wound around said main injection pipe.

5. A decoking apparatus as defined in claims 1 or 3, wherein the lower end of said auxiliary injection pipe terminates in an annular nozzle surrounding said main injection pipe.

* * * * *

UNITED STATES PATENT AND TRADEMARK OFFICE

CERTIFICATE OF CORRECTION

PATENT NO. : 4,224,108

DATED : September 23, 1980

INVENTOR(S) : TAKAHASHI ET AL

It is certified that error appears in the above-identified patent and that said Letters Patent are hereby corrected as shown below:

On The Title Page,
Please correct the name of the assignee to read:

--KUREHA KAGAKU KOGYO KABUSHIKI KAISHA, AND
CHIYODA CHEMICAL ENGINEERING & CONSTRUCTION CO., LTD.--

Signed and Sealed this

*Twelfth* Day of *May 1981*

[SEAL]

*Attest:*

RENE D. TEGTMEYER

*Attesting Officer* *Acting Commissioner of Patents and Trademarks*